United States Patent [19]

Pahr

[11] 4,062,159

[45] Dec. 13, 1977

[54] BUILDING BRICK AND WALL STRUCTURE

[76] Inventor: Gustav Oskar Pahr, 97 Deep Dene Place, West Vancouver, British Columbia, Canada

[21] Appl. No.: 494,636

[22] Filed: Aug. 5, 1974

[51] Int. Cl.[2] ..... E04B 2/20

[52] U.S. Cl. ..... 52/421; 52/437; 52/438

[58] Field of Search ..... 52/421, 437, 439, 438

[56] References Cited

U.S. PATENT DOCUMENTS

| | | | |
|---|---|---|---|
| 1,128,020 | 2/1915 | McIntyre | 52/439 |
| 1,186,592 | 6/1916 | Mathews | 52/421 |
| 3,717,967 | 2/1973 | Wood | 52/439 |

FOREIGN PATENT DOCUMENTS

| | | | |
|---|---|---|---|
| 178,178 | 4/1954 | Austria | 52/421 |
| 921,276 | 1/1947 | France | 52/421 |
| 822,600 | 11/1951 | Germany | 52/439 |
| 242,040 | 11/1925 | United Kingdom | 52/421 |
| 953,739 | 4/1964 | United Kingdom | 52/439 |

*Primary Examiner*—Alfred C. Perham

*Attorney, Agent, or Firm*—Shlesinger, Arkwright, Garvey & Dinsmore

[57] ABSTRACT

Building brick for wall construction in which brick serves concurrently as integral form for poured concrete and also provides insulation. Brick has structure to produce voids in wall to reduce volume of concrete poured, voids producing further insulation. Brick has pair of plane rectangular spaced side members connected by plane rectangular connecting members, end portions of side members extending beyond connecting members. Upper edges of connecting members spaced below upper edges of side members and lower edges of connecting members are coplanar with lower edges of side members. Detachable cover plate rests on connecting members to form cavity within brick and when concrete is poured, cavity produces void in concrete between side members, connecting members and lower surface of brick. Bricks are stacked in aligned horizontal rows and vertical columns, and are not staggered as in common brick construction, spaces between bricks when filled with concrete producing framework of horizontal and vertical concrete supports.

6 Claims, 10 Drawing Figures

BUILDING BRICK AND WALL STRUCTURE

BACKGROUND OF THE INVENTION

Field of the Invention

The invention relates to a building brick for wall construction, particularly adapted for, but not limited to, use by amateur builders.

Prior Art

Brick laying is a very old trade and, except when carried out by skilled workers, is a relatively slow means of building walls. Commonly, an outside wall consists of two parallel walls of narrow bricks separated by an air space, the air space providing insulation against sound, heat and moisture penetration. Increasing on-site labour costs are causing brick laying to be replaced by faster and more economical forms of building, such as poured concrete work or precast concrete slabs. Poured concrete work requires labour and materials for setting up form work, the form work being removed when the concrete is cured. Because of the quantity of concrete required for poured concrete work, pre-mix concrete is usually delivered to the site and thus this method is particularly suited for relatively large projects. Precast concrete work usually requires mechanised handling equipment for handling the slabs of concrete which are too heavy for manual handling. Such handling equipment again is appropriate only for the larfer projects. Also both methods above usually require an inner wall of other material to provide insulation which increases costs of construction. In view of specialized equipment and skilled labour required neither of the alternatives above is really suitable for an amateur builder building a relatively small building.

SUMMARY OF THE INVENTION

The invention reduces the difficulties and disadvantages of the prior art by providing a relatively wide hollow brick which is light enough to be handled manually and to enable relatively fast building by an amateur builder having little skill. The brick serves as an integral form for poured concrete work and has little structural strength by itself. Further, each brick produces a respective void in the surrounding poured concrete, so that many bricks produce a plurality of air spaces within the wall, thus reducing quantity of concrete poured on site, and also providing sound and heat insulation. When the brick is made of lightweight concrete, improved sound and heat insulation is attained, which permits use of larger bricks whilst maintaining ease of handling due to relatively light weight.

A building brick according to the invention has first and second spaced side members, each side member having a pair of vertical, parallel end edges and a pair of horizontal, parallel upper and lower edges. The end edges and the upper and lower edges of the first side member are coplanar with the corresponding end edges and upper and lower edges of the second side member. First and second spaced connecting members extend between the first and second side members, the connecting members having lower edges coplanar with the lower edges of the side members, and upper edges spaced below the upper edges of the side members. The connecting members have outer faces spaced inwards of the end edges of the side members so that end portions of the side members extend outwards from the brick beyond the connecting members. The four members thus define a generally rectangular-sectioned hollow brick having side faces defined by outer faces of the side members, open end faces defined in part by the end edges of the side members, an open upper face defined in part by the upper edges of the side members, and an open lower face defined by the lower edges of the side members and the lower edges of the connecting members. The brick is used in combination with a cover plate having a width defined by space between opposed inner faces of the side members and a minimum length defined by space between connecting members. Thus when the plate rests on upper edges of the connecting members a cavity is defined within the brick, the cavity having an open lower end defined by the lower edges of the connecting members and the lower edges of the side members. When the concrete is poured the cavity produces a void in the brick, reducing quantity of concrete required and increasing insulation A detailed disclosure following, related to drawings, describes preferred embodiments of the invention, which however is capable of expression in structure other than that particularly described and illustrated.

DETAILED DISCLOSURE

FIGS. 1 through 4

Figure 1:
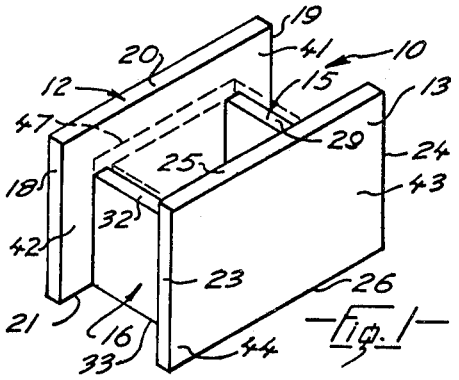
FIG. 1 is an isometric view of a brick according to the invention, a cover plate associated therewith being shown in broken outline.

A building brick 10 according to the invention, has first and second spaced side members 12 and 13, and first and second spaced connecting members 15 and 16, the connecting members extending between the first and second side members as shown. The side member 12 is a generally plane, vertically disposed, rectangular slab having a pair of vertical parallel end edges 18 and 19, and a pair of horizontal parallel upper and lower edges 20 and 21, the end edges being disposed normally to the upper and lower edges as shown. The side member 13 is a similar plane slab having end edges 23 and 24, and upper and lower edges 25 and 26. The end edges and upper and lower edges of the first side member are coplanar with the corresponding end edges and upper and lower edges of the second side member.

Figure 3:
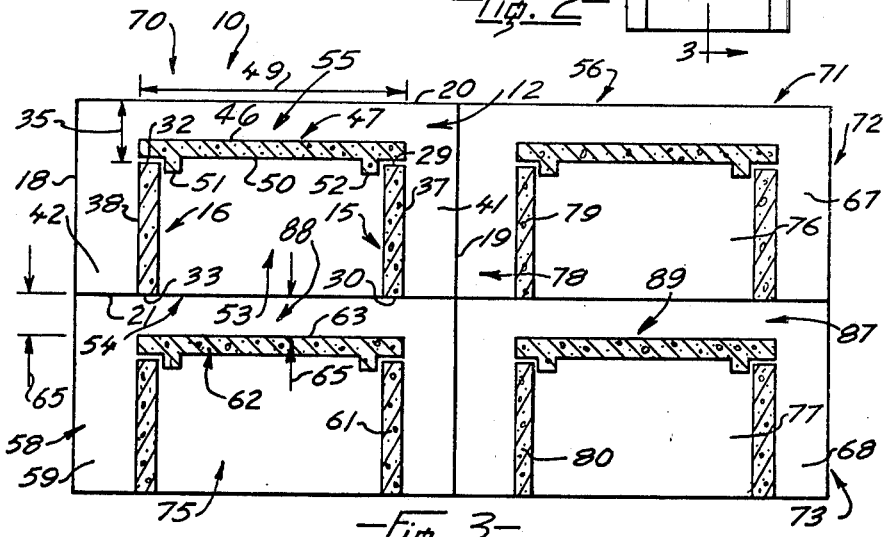
FIG. 3 is a section on 3—3 of FIG. 2 showing portions of the incomplete wall of two adjacent columns of bricks.

The first connecting member 15 is a generally plane rectangular slab having parallel upper and lower edges 29 and 30, the member extending normally between the side members 12 and 13 so that the side faces of the brick are parallel and rectangular. The member 16 is a similar rectangular slab having parallel upper and lower edges 32 and 33 respectively. As seen in FIG. 3 the lower edges 30 and 33 are coplanar with the lower edges 21 and 26 of the side edges, and the upper edges 29 and 32 are spaced below the upper edge 20 of the side member 12 by spacing 35. The connecting members 15 and 16 have outer faces 37 and 38 spaced inwards of the end edges of the side members so that end portions 41 and 42 of the side member 12 and end portions 43 and 44 of the side member 13 extend outwards from the brick beyond the connecting members 15 and 16 respectively as shown. Thus the four members define a generally rectangular-sectioned, hollow brick having side faces defined by outer faces of the side members 12 and 13, open end faces defined in part by the end edges 18, 19, 23 and 24 of the side members, an open upper face defined in part by the upper edges 20 and 25 of the side members and an open lower face defined by the lower edges 21 and 26 of the side members 12 and 13 and the lower edges 30 and 33 of the connecting members 15 and 16.

A cover plate 47, shown in broken outline in FIG. 1, is adapted to fit between inner faces of the side members 12 and 13, and to extend between the connecting members 15 and 16. Thus the plate has a maximum width 48 (FIG. 2) defined by space between the opposed inner faces of the side members, and a length 49 (FIG. 3) sufficient to support the plate on the connecting members, minimal clearances being provided. The plate 47 has an upper surface 46, and a lower surface 50 having a pair of spaced stops 51 and 52 extending therefrom and spaced inwards of ends of the plate. Outer shoulders of the stops are spaced sufficiently to fit between the opposed inner faces of the connecting members 15 and 16 so as to engage the faces snugly and to serve as means essentially to prevent movement of the cover plate relative to the brick. When the plate 47 rests on the upper edges 29 and 32 of the connecting members, weight of the plate holds the plate in place relative to the brick and reduces risk of dislocation which might otherwise occur during pouring of the concrete, as will be described. When the plate 47 is supported as above, an inner cavity 53 is defined within the brick, the cavity having an open lower end 54 defined by the lower edges 30 and 33 of the connecting members and portions of the lower edges 21 and 26 of the side members. An open-ended longitudinal cavity 55 extends between the ends of the brick and is defined in part by the upper surface 46 of the cover plate and upper portions of opposed inner faces of the side members above the surface 46.

Figure 2:
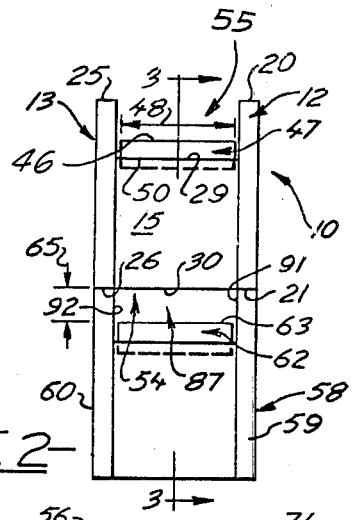
FIG. 2 is an end elevation of two similar bricks in a portion of an incomplete wall, the bricks having cover plates in position, the brick of FIG. 1 being shown on a similar lower brick.

With reference to FIGS. 2 and 3, in a portion 56 of a wall the brick 10 is supported by a similar lower brick 58. As can be seen, the bricks 10 and 58 are positioned vertically so that upper edges of side members 59 and 60 of the lower brick 58 contact the lower edges 21 and 26 of the side members 12 and 13 of the brick 10. The lower brick has a similar pair of connecting members, one designated 61, and a cover plate 62, having an upper surface 63 spaced by a clearance 65 from the lower surface 30 of the member 15. For bricks of essentially equal dimensions the clearance 58 is equal to the spacing 35 less thickness of the cover plate 62 and is sufficient to provide a required space to produce a horizontal concrete support as will be described.

Referring to FIG. 3, the portion 56 of a wall has two further similar bricks 67 and 68 disposed as shown, the brick 68 being disposed below the brick 67. For convenience of description the portion of wall can be divided into two parallel vertical columns of bricks, namely a column 70 containing the bricks 10 and 58 and a column 71 containing the bricks 67 and 68. The wall can also be divided into two parallel horizontal rows of bricks, namely an upper row 72 containing the bricks 10 and 67 and a lower row 73 containing the bricks 58 and 68. Note that in a particular column of bricks, the end edges of the side members of the upper brick are aligned with the end edges of the side members of the lower brick, and in a particular row of bricks, upper and lower edges of the side members are aligned. Thus the bricks in a particular row are are not staggered relative to adjacent upper and lower rows as in conventional brick construction. As can be seen in FIG. 2, outer plane portions of the wall formed by adjacent outer faces of the brick, that is outer faces of the side members, are generally coplanar.

Figure 4:
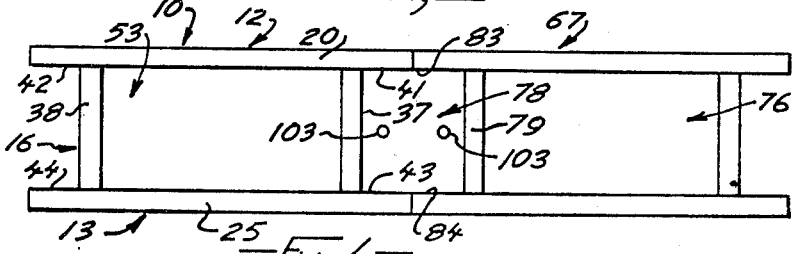
FIG. 4 is a top plan of a portion of an incomplete wall of FIG. 3, cover plates being removed.

The lower brick 58 has a cavity 75 disposed vertically below the cavity 53 of the brick 10. The bricks 67 and 68 have vertically aligned cavities 76 and 77 which are also aligned horizontally with the cavities 53 and 75 respectively. The connecting members 15 and 61 of adjacent upper and lower bricks 10 and 58 are vertically aligned, and connecting members 79 and 80 of the bricks 72 and 73 are also similarly aligned. The four adjacent connecting members define in part a vertical space 78 extending upwards between adjacent bricks. As seen in FIG. 4, between the bricks 10 and 67, an upper portion of the space 78 is further defined in part by opposed inner faces of the end portions 41 and 42 of the brick 10 and opposed inner faces of end portions 83 and 84 of the brick 67. A lower portion of the space 78 is defined in part by outer faces of the connecting members 61 and 80 and corresponding end portions of the bricks 59 and 68 respectively. As seen in FIG. 4, the vertical space 78 separates the cavities 53 and 76, and the cavities 75 and 77.

As previously defined, longitudinal cavities 88 and 89 of the bricks 58 and 68 are aligned horizontally to define a horizontal space 87 that extends between the two rows 72 and 73 of adjacent bricks. Between the bricks 10 and 58 the horizontal space has a depth equal approximately to the spacing 65 and is defined in part by opposed faces 91 and 92 of the side members 59 and 60 above the upper surface 63 of the cover plate 62, the upper surface 63 of the cover plate 62, and the lower edges 30 and 33 of the connecting members 15 and 16. A portion of the space 87 between the bricks 67 and 68 has a similar depth and is similarly defined, and as can be seen in FIG. 3, the space 87 separates the upper and lower cavities in the row of bricks.

FIG. 5

The portion 56 of the wall is shown carried on a horizontal foundation 100, a shallow layer 98 of concrete or mortar augmenting keying of the bricks to the foundation also being used if needed. Concrete is poured into the horizontal and vertical spaces of the wall so that when the wall is completed, a continuous rectangular grid or framework 101 of horizontal and vertical concrete supports is provided in the horizontal and vertical spaces, two such supports namely 102 and 103 being provided in the spaced 87 and 78 respectively. As can be seen the cavity in each brick has effectively produced a void in the poured concrete, the void providing insulation and reducing quantity of concrete required. The horizontal support 102 has upper horizontal surfaces 106 and 107 generally level with adjacent upper edges of the side members of the bricks 58 and 68, as will be described. The vertical support 103 has sides defined by the surfaces defining the vertical spaces as aforesaid. Steel reinforcing bars 108 and 109 are provided in the horizontal and vertical concrete supports 102 and 103 respectively and in adjacent supports as required. The vertical and horizontal spaces can also be used to carry conduits for services required in the building. Water or gas pipes, and electrical conduits can be embedded in the concrete with suitable outlets and connections provided where required.

Operation

Figure 5:
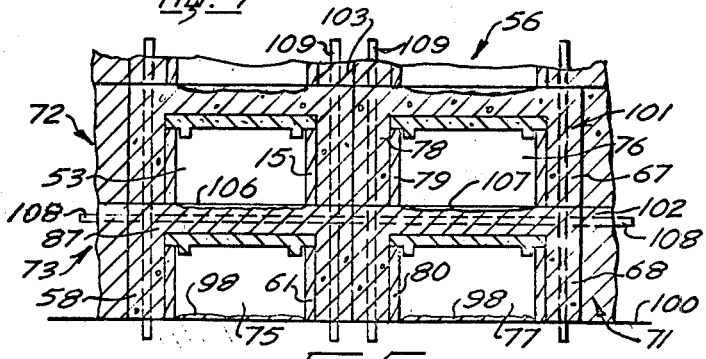
FIG. 5 is a portion of a completed wall showing cooperation between adjacent bricks and reinforcement.
Figure 6:
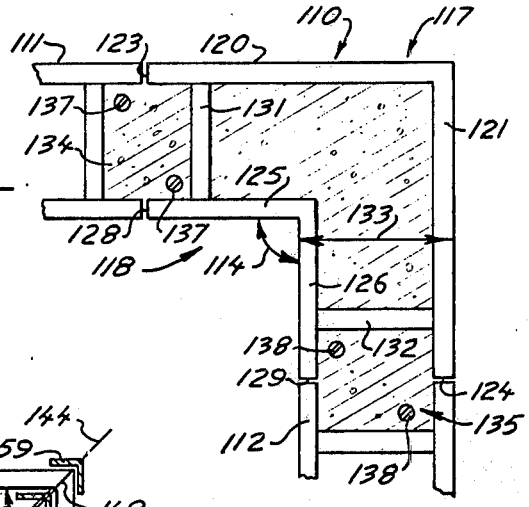
FIG. 6 is a top plan of a preferred corner brick.

With reference to FIG. 5, the lower row of bricks 73 is laid on the foundation 100 preferably directly following application of the shallow layer 98 of concrete or mortar used to improve keying and sealing of the bricks. Mortar or concrete as above is not necessarily required on the foundation, but is preferable if the foundation surface is rough or not level. Note that mortar is not necessarily required between the bricks as the bricks themselves bear little structural load. In some cases, prior to laying, it may be best for the bricks to be dipped in a cement emulsion so that the cement emulsion will form a film between adjacent bricks. The film essentially prevents leakage of concrete between edges of the side members and lower edges of the connecting members. This is of particular advantage if the edges are badly chipped such that a relatively fluid mix of concrete might leak through a wide gap. The steel reinforcing bars 109 pass upwards through the vertical spaces defined between the bricks as shown. It is preferable for the reinforcing bars to be embedded in the concrete so as to secure the wall directly to the foundation. In relatively low buildings, the walls are subject to relatively low stresses and such keying as above may not be necessary.

After the lower row of bricks is completed, that is all the bricks on one level, cover plates are fitted to each brick to produce one cavity within each brick. The horizontal reinforcing bar 108 can be fitted on the cover plates if required. Concrete is then poured between the side members of the bricks, over the plates and in the vertical spaces to a depth such that, after working of the concrete to remove air, an upper surface of the concrete is approximately level with the upper edges of the side members of the bricks. Note that lower edges of the connecting members are in contact with or spaced closely from the foundation to eliminate substantially flow of concrete under the connecting members into the cavity, thus maintaining a void in each brick. The concrete upper surface when cured forms the upper surfaces of the horizontal supports, such as the surfaces 106 and 107 of the bricks 58 and 68. A small amount of shrinkage or settling of the concrete can be tolerated but excessive shrinkage should be avoided. Care should also be taken to ensure that concrete does not extend above the upper surfaces of the bricks, nor that splashes of concrete are permitted to cure on the upper surfaces.

The second layer or row 72 of bricks can immediately be laid upon the first row before the concrete has cured. When the concrete in the first layer, that is the lower layer of bricks, has partially cured, so as to resist displacement "en masse," the second layer of concrete can be poured. The concrete fills up the horizontal and vertical spaces as before and to a position level with upper edges of the second row of bricks, further horizontal supports to be fitted if required.

The process is repeated for as many rows of bricks as required, the wall progressing upwards, one row of bricks at a time, after the initial curing of the adjacent lower row of bricks. Note that if the concrete is poured semicontinuously as described without complete curing, discontinuities between adjacent rows of concrete supports are reduced, producing an essentially continuous vertical column between each column of bricks. Such a method permits pouring of relatively small quantities of concrete after each row of bricks is completed, which is easier for the amateur builder having limited concrete making and distributing facilities. The concrete is mixed so as to have a consistency such that flow through small gaps between adjacent bricks and beneath the connecting members is negligible.

Material and Dimensional Considerations

The bricks are made from a lightweight concrete mixture in which lightweight aggregate or other known means are used to reduce density of the concrete. The lower density permits relatively large bricks to be handled easily by one man and also provides a measure of heat and sound insulation. The lower density reduces strength of the brick but this is not very important as the brick is essentially non-load bearing in the finished structure and is merely required to retain a relatively low hydraulic head of concrete whilst curing.

The dimensions of the brick can be selected for convenience, one example being as follows. The brick 10 (FIG. 1) has a length of 20 inches, a height of 10 inches and a width of 8 inches. The spacing 35 (FIG. 3) is 3 inches and the connecting members can be spaced inwards from adjacent end edges a distance of 3 inches. Thickness of the members and cover plates are between 1 inch and 1½ inches.

FIG. 6

A corner brick 110 is for use at a corner of a structure having intersecting first and second walls, wall portions 111 and 112 of which only being shown. The corner is defined by intersection of the first and second walls at a corner angle 114, which angle is commonly 90°.

The corner brick 110 has first and second side members 117 and 118, each side member having a pair of vertically parallel end edges and a pair of horizontal parallel upper and lower edges, similarly to the side members 15 and 16 of FIG. 1. End edges and upper and lower edges of the first side member are coplanar with the corresponding end edges and upper and lower edges of the second side member, also similarly to the brick of FIG. 1. The first side member 117 is generally L-shaped and has two side portions 120 and 121 secured together or integral and inclined at the corner angle. The side portions are generally place rectangular slabs and have outer end edges 123 and 124 defining end edges of the first side member. The second side member 118 is also generally L-shaped and has two similar side portions 125 and 126 also secured together or integral and inclined at the corner angle, the side portions 125 and 126 of the second side member being parallel to and spaced from adjacent side portions 120 and 121 of the first side member. The side portions 125 and 126 are shorter than the side portions 120 and 121 so that outer end edges 128 and 129 of the side portions 125 and 126 defining end edges of the second side member are coplanar with the adjacent end edges 123 and 124 respectively of the first side member.

A first connecting member 131 extends normally between the pair of oppositely facing side portions 120 and 125, and a second connecting member 132 extends normally between the remaining pair of oppositely facing side portions 121 and 126. The connecting members are plane, generally rectangular slabs having lower edges coplanar with the lower edges of the side members, and upper edges spaced below the upper edges of the side members, as in the brick 10.

Thus the corner brick 140 is an L-shaped hollow brick having a width 133 equal to the width of the first and second walls so as to produce an essentially smooth transition from the wall to the corner brick. The side portions 120 and 121 preferably have a length equal to the lengths of the side portions 12 and 13 of the brick 10. Dimensions are selected so that the connecting members 131 and 132 are spaced from the outer end edges of the side portions so as to provide vertical spaces 134 and 135 at opposite ends of the brick. The spaces 134 and 135 accept concrete and reinforcing members 137 and 138 similarly to the bricks in the first and second walls. Bent horizontal reinforcing bars (not shown) can also be fitted if required.

As described previsously, one layer of bricks is laid before pouring concrete and the corner bricks are used as needed. A solid corner is preferable where strength is required and thus the space between the connecting members 131 and 132 is filled with concrete, with additional steel reinforcing as required. The vertical spaces 134 and 135 between adjacent bricks are also filled with concrete and reinforcing bars 137 and 138 used as required. This produces a solid corner, having an enhanced structural strength considered necessary for most corners. For a low stressed building where solid corners are not considered necessary, an L-shaped cover plate, (not shown) can be fitted so as to extend between the connecting members 131 and 132 and inner portions of the side portions 120, 121, 125 and 126. The plate produces a column of voids at the corners separated by horizontal concrete supports, similarly to the resulting structure of the straight wall.

ALTERNATIVES AND EQUIVALENTS

Figure 7:
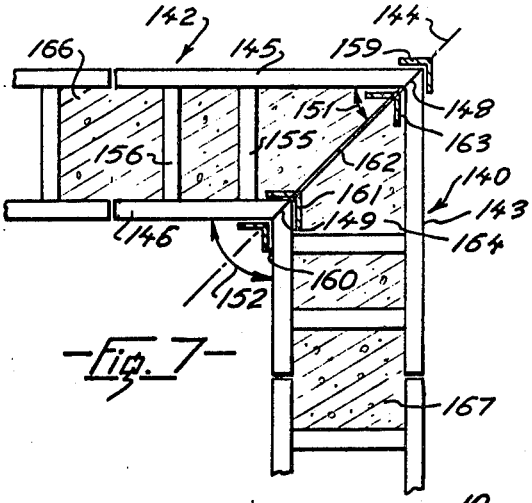
FIG. 7 is a top plan of two alternative corner bricks cooperating at a corner.
Figure 8:
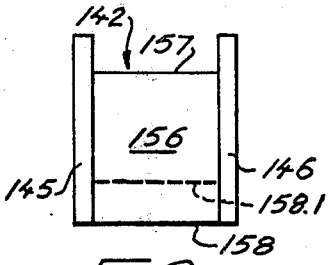
FIG. 8 is an end elevation of one of the alternative corner bricks of FIG. 7.

FIGS. 7 and 8

An alternative corner brick 140 includes a pair of similar corner brick portions 142 and 143, the portions being disposed symmetrically about a central axis 144 of the corner. The corner brick portion 142 has first and second side members 145 and 146, each side member having a pair of vertical parallel end edges and a pair of horizontal parallel upper and lower edges. The end edges and the upper and lower edges of the first side member are coplanar with corresponding end edges and upper and lower edges of the second side member.

At an inner end of the brick, the end edges of the first and second side members are chamfered at 148 and 149 so as to be inclined at an angle 151 to the face 142, the angle 151 being one-half of a corner angle 152, that is 45°. First and second spaced connecting members 155 and 156 extend between the first and second side members, and have outer faces spaced inwards of the end edges of the side members so that end portions of the side members extend outwards from the connecting members, somewhat similarly to the brick 10 of FIG. 1. As seen in FIG. 8, the connecting member 156 has an upper edge 157 spaced inwards from the upper edges of the brick, and a lower edge 158 coplanar with lower edges of the brick. Thus this brick can be used only at one side of the corner and an oppositely arranged brick (a mirror image) is required at the other side of the corner.

Alternatively, the lower edge 158 can also be spaced inwards, shown as broken line 158.1. This alternative permits the same brick to be used at either side of the corner, and also provides clearance for thicker horizontal supports of poured concrete to extend into the corner. Space between the connecting members is filled with concrete for additional rigidity that is desirable at a corner. Length of the side member 142 is equal to the length of the side member 12 of the brick of FIG. 10 for simplicity of construction.

The brick portion 143 has corresponding end edges complementary to the end edges 148 and 149 when the bricks are laid so that edges of bricks are adjacent each other to form right angle inner and outer corners as shown. Right angle sectioned strips 159 and 160 are disposed vertically to engage the inner and outer corners respectively and are secured thereto by a tension member, for instance a wire 162, extending between the angled strips. The wire urges the strips against the joints between the bricks to eliminate substantially loss of poured concrete therethrough. Alternative similar right angle sectioned strips 161 and 163 can be fitted inside the corner and are held in place by the concrete. A vertical space 164 defined by portions of the side members adjacent the chamfered edges, the connecting member 155 and the corresponding connecting member for the brick 140 is filled with concrete when the adjacent walls are poured. Similarly to bricks in the straight wall, vertical spaces 166 and 167 at outer ends of the corner bricks are also filled with concrete, steel reinforcing being provided where necessary.

Figure 9:
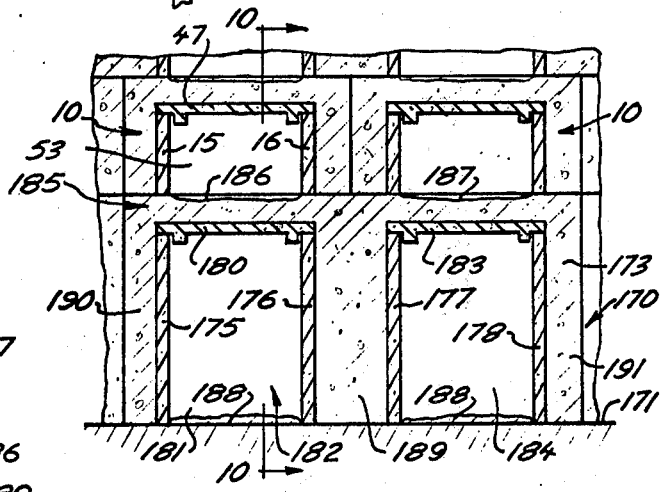
FIG. 9 is a section through a portion of a wall using an alternative brick.
Figure 10:
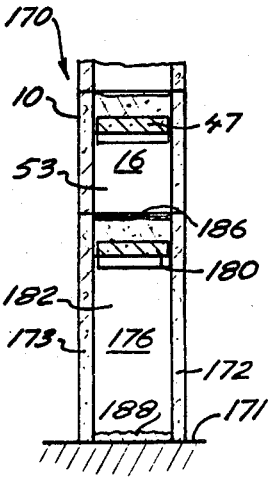
FIG. 10 is a fragmented section on 10—10 of FIG. 9.

FIGS. 9 and 10

An alternative brick 170 is for use in relatively large sections of straight wall in which rapid building progress is required and closely spaced discontinuities such as windows are not required. The brick 170 has a length equal to twice the length of the brick 10, a height equal to twice the height of the brick 10, and a width equal to the width of the brick 13. Thus the brick 170 has two main dimensions which are simple multiples of the dimensions of the brick 10, and as seen in FIG. 8 is compatible in other ways with the brick 10.

The brick 170 is shown laid on a foundation 171 and has first and second spaced side members 172 and 173, and four spaced parallel connecting members 175 through 178 respectively extending therebetween. The first set of connecting members 175 and 176 are spaced at a spacing equal to the spacing between the connecting member 15 and 16 of the brick 10, two of which bricks are shown laid on the brick 170. The members 175 and 176 support a cover plate 180 which, with the connecting members and portions of the side members, defines in part a cavity 181 having an open lower end 182 similar to the cavity 53 of the brick 10. The connecting members 177 and 178 are similarly spaced so as to accept a cover plate 183 similar to the plate 180, which defines in part a second cavity 184. Thus the brick 170 has two cavities 181 and 184 spaced apart, the spacing between the cavities being equal to the spacing between the cavities of the two adjacent bricks 10 laid directly on top of the brick 170.

A thin layer of concrete 188 is spread over the foundation before the bricks are laid thereon, the thin layer keying the bricks and sealing irregularities. Concrete is then poured onto the brick 170 to a depth twice that of the brick 10 to produce a horizontal support 185 having upper surfaces 186 and 187 generally level with upper surfaces of the side members 172 and 173. As can be seen, when the concrete has cured a vertical support 189 is formed between the connecting members 176 and 177. The support 198 is of a similar size to the vertical support 103, FIG. 5, obtained with the bricks 10, and is spaced at similar distances from adjacent vertical supports 190 and 191, shown in part at ends of the brick. As can be seen, the horizontal support 185 is more widely spaced from adjacent horizontal supports than those obtained with the bricks 10. Vertical and horizontal reinforcing bars (not shown) are fitted into the spaces as required before the concrete is poured, similarly to the wall of FIG. 5.

Thus the brick 170 is generally equivalent to the brick 10 but provides a more rapid rate of building, uses less concrete and produces a wall structure having a grid or framework of supporting members more open than that obtained with the brick 10.

I claim:

1. A wall constructed of horizontal rows and vertical columns of similar bricks, in which each brick has:

i. first and second spaced side members, each side member having a pair of vertical, parallel end edges and a pair of horizontal parallel upper and lower edges, the end edges and upper and lower edges of the first side member being coplanar with the corresponding end edges and upper and lower edges of the second side member, ii. first and second spaced connecting members extending between the first and second side members, the connecting members having lower edges coplanar with the lower edges of the side members, and upper edges spaced below the upper edges of the side members, the connecting members having outer faces spaced inwards of the end edges of the side members so that end portions of the side members extend outward from the brick beyond the connecting members, the four members of each brick defining a generally rectangular-sectioned hollow brick having side faces defined by the side members, open end faces defined in part by the end edges of the side members, an open upper face defined in part by the upper edges of the side member, and an open lower face defined by the lower edges of the side members and the lower edges of the connecting members, and in which each brick further includes:

iii. a cover plate having a width defined by space between opposed faces of the side members and a length sufficient to support the plate on the connecting members, means being provided to prevent movement of the plate relative to the brick, the plate having an upper surface spaced below the upper edges of the side members sufficiently to provide a longitudinal cavity extending along the brick to ends thereof, the cover plate supported on the upper edges of the connecting members to define therebeneath an inner cavity within the brick, the inner cavity having an open lower end defined by the lower edges of the connecting members and portions of the lower edges of the side members;

the bricks of the wall being disposed so that, in a particular column of bricks the end edges of upper bricks are aligned with the end edges of lower bricks so as to align the inner cavities vertically, and in particular row of bricks upper and lower edges of bricks are aligned so as to align the longitudinal cavities horizontally, and in a plane portion of the wall upper and lower faces of all the bricks are generally coplanar; the wall further including:

iv. a rectangular grid of horizontal and vertical concrete supports provided in spaces defined by portions of adjacent bricks; the horizontal concrete supports being contained in the aligned longitudinal cavities and being defined in part by opposed faces of the side members above a cover plate, lower edges of connecting members of an adjacent upper brick and the upper surface of the cover plate; the vertical concrete supports extending between adjacent vertically aligned inner cavities and being defined in part by opposed inner faces of the end portions of the side members and opposed outer faces of the connecting members of adjacent bricks, the open lower end of the inner cavity within each brick being closed by a portion of an upper surface of a horizontal support of concrete within the adjacent lower brick.

2. A wall as claimed in claim 1 in which each brick is characterized by:

i. the side members being generally plane, vertically disposed, rectangular slabs, iii. the connecting members being generally rectangular slabs having parallel upper and lower edges, the connecting members extending normally between the side members, so that the side faces of each brick are parallel and rectangular.

3. A wall as claimed in claim 1 in which the means to prevent movement of each plate relative to the respective brick includes:

a. a pair of spaced stops extending from the lower surface of the plate, the stops having outer shoulders spaced sufficiently to fit between the opposed inner faces of the connecting members so as to engage the inner faces thereof.

4. A wall as claimed in claim 1 in which the vertical concrete supports contain reinforcing members.

5. A wall as claimed in claim 1 in which the horizontal concrete supports contain reinforcing members.

6. A wall as claimed in claim 1 in which both the horizontal and vertical concrete supports contain reinforcing members.

* * * * *